US006142392A

United States Patent [19]

Takeda et al.

[11] Patent Number: 6,142,392

[45] Date of Patent: Nov. 7, 2000

[54] FUEL INJECTOR FOR AN INTERNAL COMBUSTION ENGINE

[75] Inventors: Keiso Takeda, Mishima; Tomojiro Sugimoto, Susono, both of Japan

[73] Assignee: Toyota Jidosha Kabushiki Kaisha, Toyota, Japan

[21] Appl. No.: 09/294,050

[22] Filed: Apr. 19, 1999

[30] Foreign Application Priority Data

May 28, 1998 [JP] Japan ..... 10-148080

[51] Int. Cl.[7] ..... F02M 61/00

[52] U.S. Cl. ..... 239/533.12; 239/533.2; 239/533.3; 239/533.14

[58] Field of Search ..... 239/533.2, 533.3, 239/533.12, 533.14

[56] References Cited

U.S. PATENT DOCUMENTS

| | | | |
|---|---|---|---|
| 4,721,253 | 1/1988 | Noguchi et al. | 239/533.12 X |
| 5,346,137 | 9/1994 | Okamoto et al. . | |
| 5,353,992 | 10/1994 | Regueiro . | |
| 6,019,296 | 2/2000 | Yamamoto et al. | 239/533.2 |
| 6,045,063 | 4/2000 | Koike et al. | 239/533.3 |

FOREIGN PATENT DOCUMENTS

| | | | |
|---|---|---|---|
| 446 892 | 12/1912 | France . | |
| 82772 | 5/1938 | France | 239/533.12 |
| 42 03 343 C1 | 5/1993 | Germany . | |
| 59-87271 | 5/1984 | Japan . | |
| 3-78562 | 4/1991 | Japan . | |
| 9-126095 | 5/1997 | Japan . | |
| 11-303710 | 11/1999 | Japan . | |
| 9486 | 8/1923 | Netherlands | 239/533.12 |

*Primary Examiner*—Andres Kashnikow
*Assistant Examiner*—Robin O. Evans
*Attorney, Agent, or Firm*—Oliff & Berridge, PLC

[57] ABSTRACT

In a fuel injector for an internal combustion engine having an injection hole, a valve body, and a fuel reservoir on the downstream side of a seat portion of the valve body, the width of the injection hole is gradually narrowed inward at a predetermined included angle, an opening on the outer side of the injection hole has a width sufficiently larger than the height thereof. The tip of the fuel reservoir is communicated with the injection hole via a passage portion which has a uniform cross section. On each transverse plane within the height of the injection hole, the tip of the fuel reservoir has an arc shape, on the transverse plane passing through the center of the height of the injection hole, the tip of the fuel reservoir has a hemicircle shape and the vertex of the predetermined included angle is located on the upstream side of the center of the hemicircle shape.

3 Claims, 4 Drawing Sheets

FUEL INJECTOR FOR AN INTERNAL COMBUSTION ENGINE

BACKGROUND OF THE INVENTION

1. Field of the Invention

The present invention relates to a fuel injector for an internal combustion engine and, particularly, to a fuel injector for an internal combustion engine in which the injection hole is formed in the shape of a slit to produce the spray of a flat fan shape.

2. Description of the Prior Art

In a fuel injector for supplying fuel to an internal combustion engine, the injection hole is formed in the shape of a slit to produce a spray of the shape of a flat fan. Japanese Unexamined Patent Publication (Kokai) No. 3-78562 discloses such a fuel injector for an internal combustion engine. The spray of the shape of a flat fan formed by the fuel injected from the slit-like injection hole of this fuel injector has a small dispersion in concentration and a greatly increased surface area of the spray compared with that of the spray of an ordinary conical shape, enabling nearly all of the fuel to come into sufficient contact with the air and, hence, to be quickly atomized and mixed. This makes it possible to supply, to the internal combustion engine, a fuel spray having a small dispersion in the concentration and in which the fuel is sufficiently atomized.

There, however, remains a problem in that with the slit-like injection hole, it is not easy to adjust the flow rate of the fuel and it is difficult that the flat fan shape of the spray corresponds precisely to the shape of the slit-like injection hole. The flow rate of the fuel varies depending upon the minimum sectional area of the injection hole. In order to set the flow rate of the fuel to a desired value, the minimum sectional area of the injection hole must be correctly set. In the case that the fan-shaped slit-like injection hole is formed to communicate with a general fuel reservoir having a hemispherical shape, the area of the communication portion between the injection hole and the fuel reservoir is the minimum sectional area of the injection hole, if geometrically simplified, the area can be considered to be the area of the region where a curved surface meets a quadrangular pyramid. Therefore, a small change in the position of the slit-like injection hole causes a change in the sectional area of the communication portion that is opened to the fuel reservoir, i.e., a change of the minimum sectional area of the injection hole, making it difficult to obtain a desired amount of injected fuel. In the slit-like injection hole that produces the spray of the shape of a flat fan, furthermore, the flow of the fuel easily becomes nonuniform. Particularly, it is difficult that the fuel flows in the side regions of the injection hole in the flattened direction as same as in the central region thereof due to the wall resistance of the injection hole, the included angle of the spray of the fan shape tends to become smaller than the included angle of the injection hole of the fan shape, and the spray becomes thin in the side regions of the spray in the flattened direction.

SUMMARY OF THE INVENTION

It is therefore an object of the present invention to provide a fuel injector for an internal combustion engine which can obtain a desired amount of injected fuel if the position of the slit-like injection hole of a fan shape varies slightly, and can obtain the spray of a desired flat fan shape.

According to the present invention, there is provided a fuel injector for an internal combustion engine, comprising an injection hole, a valve body, and a fuel reservoir on the downstream side of a seat portion of the valve body, wherein the width of the injection hole is gradually narrowed inward at a predetermined included angle, an opening on the outer side of the injection hole has a width sufficiently larger than the height thereof, the tip of the fuel reservoir is communicated with said injection hole via a passage portion which has a uniform cross section, on each transverse plane within the height of said injection hole, the tip of the fuel reservoir has an arc shape, on the transverse plane passing through the center of the height of the injection hole, the tip of the fuel reservoir has a hemicircle shape and the vertex of the predetermined included angle is located on the upstream side of the center of the hemicircle shape.

The present invention will be more fully understood from the description of the preferred embodiments of the invention as set forth below, together with the accompanying drawings.

DESCRIPTION OF THE PREFERRED EMBODIMENT

Figure 1:
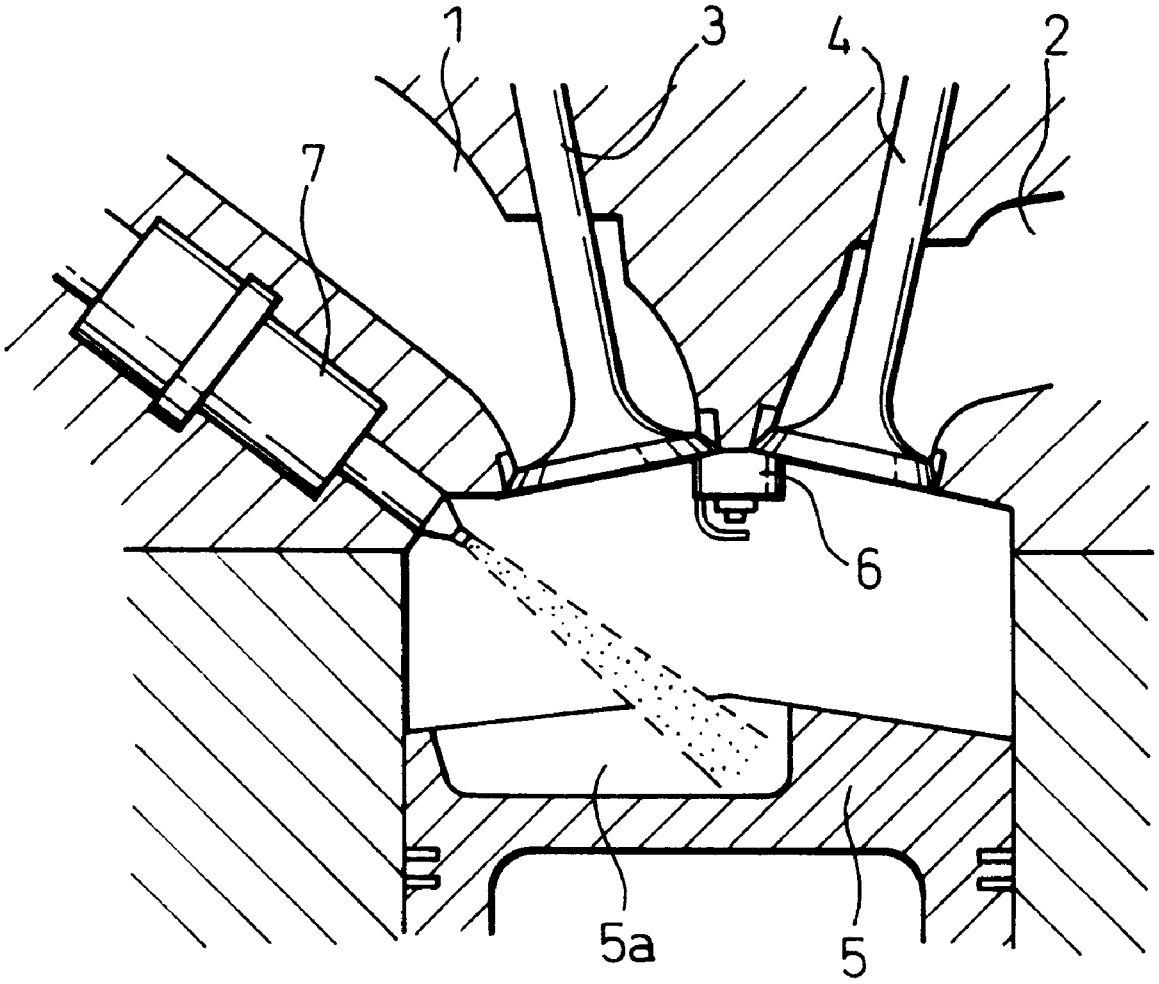
FIG. 1 is a sectional view schematically illustrating a part of direct cylinder injection-type spark-ignition internal combustion engine equipped with a fuel injector according to an embodiment of the present invention.

FIG. 1 is a sectional view schematically illustrating a part of direct cylinder injection-type spark-ignition internal combustion engine equipped with a fuel injector 7 according to an embodiment of the present invention. In FIG. 1, reference numeral 1 denotes an intake port and 2 denotes an exhaust port. The intake port 1 is communicated with the cylinder via an intake valve 3, and the exhaust port 2 is communicated with the cylinder via an exhaust valve 4. Reference numeral 5 denotes a piston, 5*a* denotes a concave combustion chamber formed in the top surface of the piston 5, and reference numeral 6 denotes a spark plug arranged above the combustion chamber. The fuel injector 7 directly injects the fuel into the cylinder.

Figure 2:
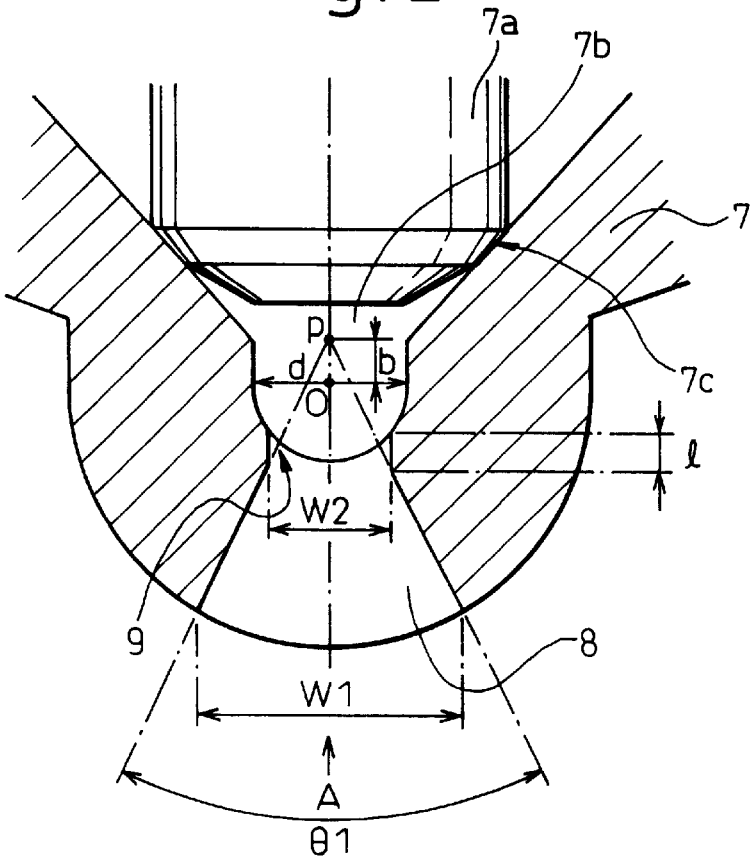
FIG. 2 is an enlarged sectional view illustrating the vicinity of an injection hole of the fuel injector of FIG. 1.
Figure 3:
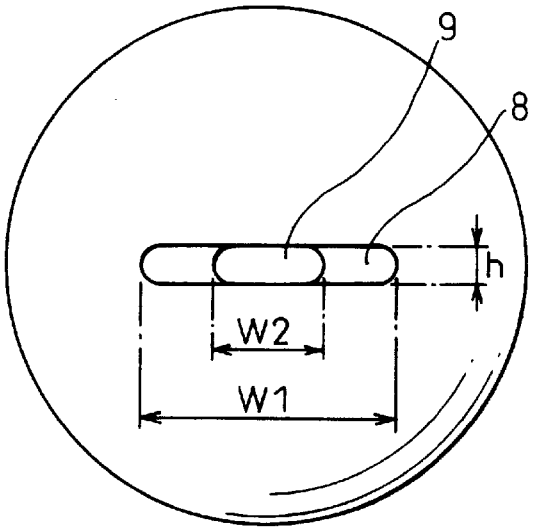
FIG. 3 is a view of part of FIG. 2 viewed from the direction of an arrow (A)

FIG. 2 is an enlarged sectional view illustrating the vicinity of an injection hole 8 of the fuel injector 7, and FIG. 3 is a view of part of FIG. 2 viewed from the direction of an arrow (A). In these drawings, reference numeral 7*a* denotes a valve body, 7*b* denotes a fuel reservoir communicated with the injection hole 8, and 7*c* denotes a nozzle seat portion that can be closed by the valve body 7*a*. The high pressure fuel is supplied to the fuel reservoir 7*b* via the nozzle seat portion 7*c* only when the valve body 7*a* is pulled up, whereby the fuel pressure in the fuel reservoir 7*b* is increased, and the fuel is injected from the injection hole 8.

An opening on the outer side of the injection hole 8 at the downstream end in a direction in which the fuel is injected, is flat in cross section and has the shape of a nearly rectangular slit with a width (w1) larger in the flattened direction than a height (h) thereof. The injection hole 8 has the shape of a fan of an included angle (θ1) of which the width is gradually narrowed inward, i.e., gradually narrowed toward the upstream side in the direction in which the fuel is injected, so that the fuel can be injected at a predetermined angle in the direction of width. The fan-shaped injection hole 8 is also flat in cross section at an upstream end in the direction of the fuel injection, and has a nearly rectangular shape in cross section with a height (h) and a width (w2). The height of the injection hole 8 is uniform in the direction of injection in a fan shape within a predetermined angle in the direction of width. A passage portion 9 of a rectangular shape in cross section with a height (h) and a width (w2), is formed between the injection hole 8 and the fuel reservoir 7*b*. On the upstream side of the injection hole 8, there is formed a fuel passage having a uniform cross section over a length (l) in the direction of fuel injection. The tip portion of the fuel reservoir 7*b* has a hemispherical shape of a diameter (d), so that the fuel pressure in the fuel reservoir 7*b* equally acts on each portion of the injection hole 8 in the direction of injection. Furthermore, in the transverse plane passing through the center of height of injection hole 8, a vertex (P) of the fan shape of the injection hole 8 is deviated by an amount (b) toward the upstream side from the center (O) of the spherical surface of the fuel reservoir 7*b* in the direction of fuel injection.

The fuel injected from the injection hole 8 of the thus constituted fuel injector 7 forms a flat fan-shaped spray having a relatively small thickness corresponding to the height (h) of the injection hole 8, and whereby nearly all the fuel comes into sufficient contact with the air taken into the cylinder and is favorably atomized. Furthermore, since the passage portion 9 having a constant sectional area is formed in the communication portion between the injection hole 8 and the fuel reservoir 7*b*, the amount of the fuel that flows into the injection hole 8 is determined by the passage portion 9. In forming the injection hole 8, therefore, even if the positions of the injection hole 8 and the fuel reservoir 7*b* are changed relative to each other due to error in the position of the injection hole 8, the area of the communication portion between the injection hole 8 and the fuel reservoir 7*b*, i.e., the opening area of the communication portion to the fuel reservoir 7*b* is always constant. Accordingly, a desired amount of injected fuel can be obtained irrespective of an error in the position at where the injection hole 8 is formed.

In a general slit-like injection hole, the fuel hardly flows in the side regions thereof. To solve this problem, in the injection hole 8 of the present embodiment, the vertex (P) of the injection hole 8 of the fan shape is located on the upstream side of the direction of fuel injection to deviate by an amount (b) from the center (O) of the spherical surface of the fuel reservoir 7*b*. The fuel flow from the fuel reservoir 7*b* into the injection hole 8 can be typically considered to be constituted by main radial flows with the center (O) of the spherical surface of the fuel reservoir 7*b* as a center and flows in the flattened direction, i.e., in the direction of width along the spherical surface of the fuel reservoir 7*b*. Therefore, the direction in which the fuel flows into the injection hole 8 varies depending upon a change in the position of the center (O) of the spherical surface of the fuel reservoir 7*b* with respect to the injection hole 8 of the fan shape, to seriously affect the shape of the spray that is formed.

Figure 4:
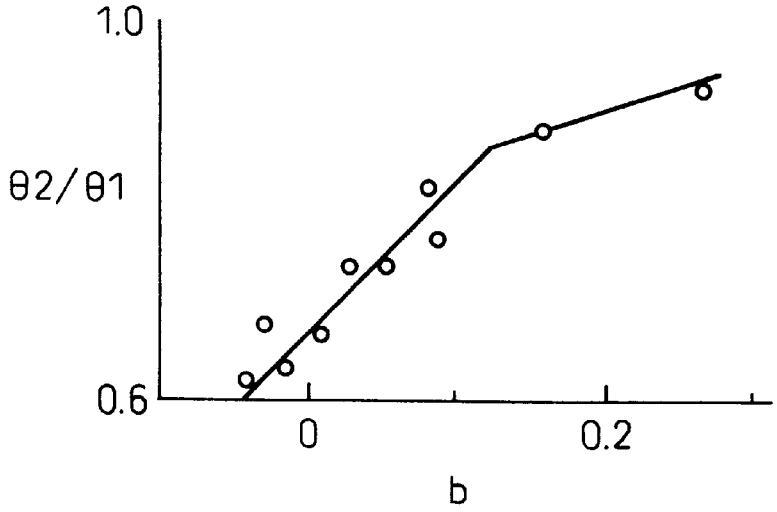
FIG. 4 is a graph illustrating a relationship between the shape of the spray and the amount of deviation of the vertex of the fan shape of the injection hole from the center of the hemispherical surface of a fuel reservoir.
Figure 5:
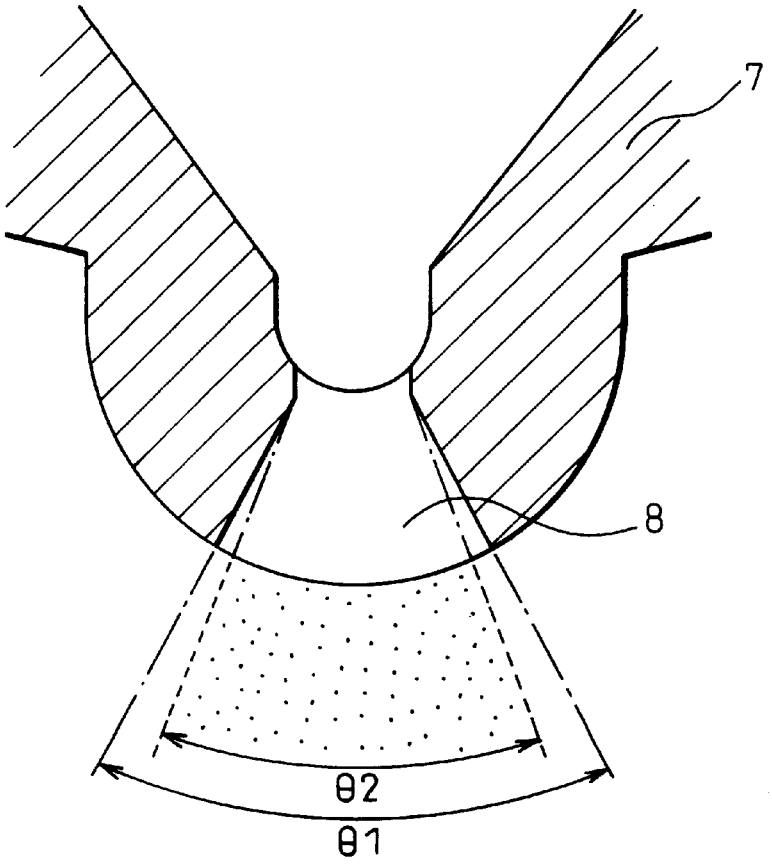
FIG. 5 is a view for explaining a relationship between the included angle of the spray and the included angle of the injection hole of the fan shape.

FIG. 4 is a graph illustrating a relationship between the position of the center (O) of the spherical surface of the fuel reservoir 7*b* relative to the injection hole 8 of the fan shape and the shape of the spray that is formed, wherein the abscissa represents the amount (b) of deviation of the vertex (P) of the fan shape of the injection hole 8 toward the upstream side in the direction of fuel injection from the center (O) of the spherical surface of the fuel reservoir 7*b*, and the ordinate represents the ratio of the included angle (θ2) of the fan shape of the spray that is really formed under the standard atmospheric pressure to the included angle (θ1) of the fan shape of the injection hole 8. Referring to FIG. 5, the included angle (θ2) of the spray of the fan shape that is really formed tends to become smaller than the included angle (θ1) of the injection hole 8 of the fan shape. The ratio (θ2/θ1) is the approximation rate of the included angle (θ2) of the spray really formed to the included angle (θ1) of the injection hole 8. The data of the diagram of FIG. 4 are obtained by setting the length (l) of the passage portion to 0.1 mm constantly, setting the included angle (θ1) of the injection hole 8 of the fan shape to 70 degrees constantly, and by changing the diameter (d) of the fuel reservoir 7*b* to change the amount (b) of deviation while keeping the amount of fuel injection constant. The spray of a flat fan shape can be formed irrespective of the amount (b) of deviation of the vertex (P) of the injection hole 8 of the fan shape toward the upstream side in the direction of fuel injection from the center (O) of the spherical surface of the fuel reservoir 7*b*. Depending upon the amount (b) of deviation, however, the ratio (θ2/θ1) of the vertical angle (θ2) of the spray of the fan shape really formed to the included angle (θ1) of the injection hole 8 of the fan shape undergoes a great change. That is, as the amount of deviation (b) decreases, the included angle (θ2) of the spray of the fan shape that is really formed relatively decreases and the approximation rate to the shape of the injection hole decreases. As the amount (b) of deviation increases, on the other hand, the approximation rate increases. This is attributed to, as the amount (b) of deviation increases, the flow in the direction of width, i.e., toward both sides of the injection hole 8, increases in the main fuel flow into the injection hole 8. Therefore, as the amount (b) of deviation increases, the shape of the spray really formed is closer to the shape of the injection hole and, besides, the fuel flow is increased on both side portions of the injection hole 8, and the spray does not become thin in the side regions thereof in the flattened direction.

Figure 6:
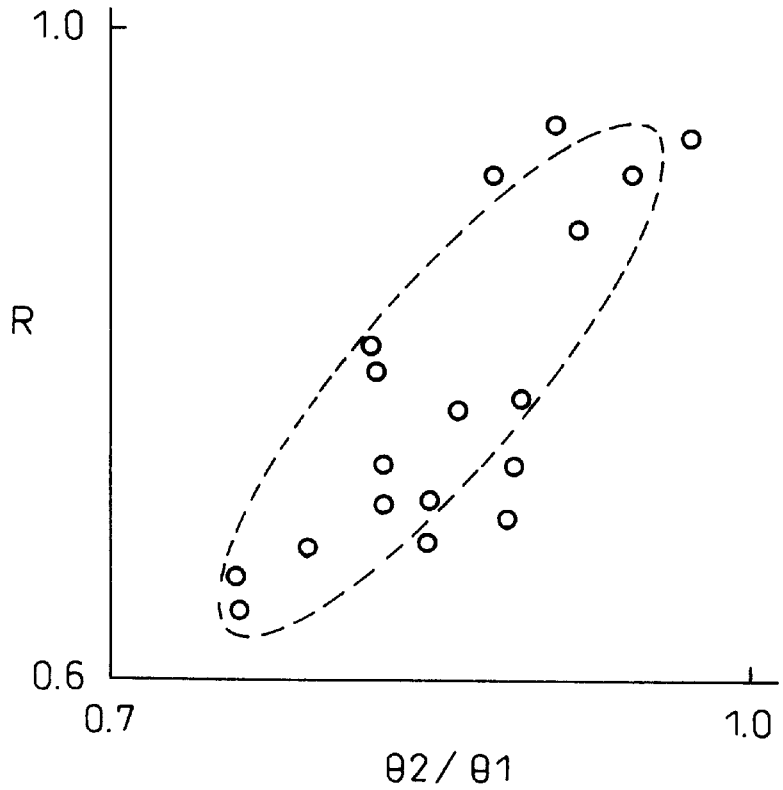
FIG. 6 is a graph illustrating a change in the shape of the spray depending upon the atmospheric pressure.

The ratio of the vertical angle θ2 of the spray of the fan shape really formed to the vertical angle θ1 of the injection hole 8 of the fan shape under the atmospheric pressure, is related to a change in the shape of the spray caused by a high atmospheric pressure. FIG. 6 is a graph illustrating a change in the shape of the spray caused by the high atmospheric pressure, wherein the abscissa represents the ratio (θ2/θ1) of the vertical angle (θ2) of the spray of the fan shape really formed under the standard atmospheric pressure to the included angle θ1 of the injection hole 8 of the fan shape, and the ordinate represents the ratio (R) of the included angle of the spray under a high atmospheric pressure or, concretely, under an atmospheric pressure of 0.4 MPa to the vertical angle of the spray under the standard atmospheric pressure. It has been known that the included angle or the diverging angle of the spray decreases with an increase in the atmospheric pressure, and the spray contracts. Therefore, the above-mentioned ratio (R) is an inverse number of the contraction factor of the spray. Concerning the reduction in the included angle of the spray due to a rise in the atmospheric pressure, a correlation is found, as shown in FIG. 6, in the ratio (θ2/θ1) of the included angle (θ2) of the spray of the fan shape really formed under the standard atmospheric pressure to the included angle (θ1) of the injection hole 8 of the fan shape. That is, the included angle of the spray contracts greatly due to the rise in the atmospheric pressure when the fuel injector 7 produces the spray which has a small ratio (θ2/θ1) of the included angle (θ2) of the spray of the fan shape really formed under the standard atmospheric pressure to the vertical angle (θ1) of the injection hole 8 of the fan shape, and in which the included angle (θ2) of the spray of the fan shape really formed under the standard atmospheric pressure is smaller than the included angle (θ1) of the injection hole 8 of the fan shape. This is chiefly attributed to the fact that the main fuel hardly flows in the sides of the injection hole 8. In the direct cylinder injection-type spark-ignition internal combustion engine, it is desired that the spray has a large included angle when a homogeneous mixture gas is formed in the cylinder by the intake stroke fuel injection, and the included angle of the spray is contracted to a suitable degree when a stratified mixture gas is formed in the combustion chamber in the compression stroke. When the included angle of the spray is greatly contracted in the compression stroke, i.e., under a high atmospheric pressure, however, the fuel is concentrated too much and the atomization becomes insufficient, which is not desirable.

According to the present embodiment, therefore, the vertex (P) of the injection hole 8 of the fan shape is located on the upstream side of the center (O) of the spherical surface of the fuel reservoir 7*b* in the direction of fuel injection. Therefore, the included angle of the spray is not contracted to a conspicuous degree under a high atmospheric pressure, and the spray of a flat fan shape is obtained having a included angle close to the included angle of the injection hole 8 of the fan shape. Upon increasing the amount (b) of deviation of the vertex (P) of the injection hole 8 of the fan shape toward the upstream side of the center (O) of the spherical surface of the fuel reservoir 7*b* in the direction of fuel injection, the ratio (θ2/θ1) of the included angle (θ2) of the spray of the fan shape really formed to the vertical angle (θ1) of the injection hole 8 of the fan shape, approaches 1. Upon increasing the amount (b) of deviation of the vertex (P) of the injection hole 8 of the fan shape toward the upstream side of the center (O) of the spherical surface of the fuel reservoir 7*b* in the direction of fuel injection to be not smaller than 0.2 mm, furthermore, the included angle (θ2) of the spray of the fan shape really formed can be brought more close to the vertical angle (θ1) of the injection hole 8 of the fan shape. Besides, a change in the ratio of the included angle (θ2) of the spray of the fan shape really formed to the vertical angle (θ1) of the injection hole 8 of the fan shape, becomes small relative to a change in the amount (b) of deviation. Accordingly, the effect caused by error in the amount (b) of deviation can be decreased, and the spray can be formed as contemplated.

Figure 7:
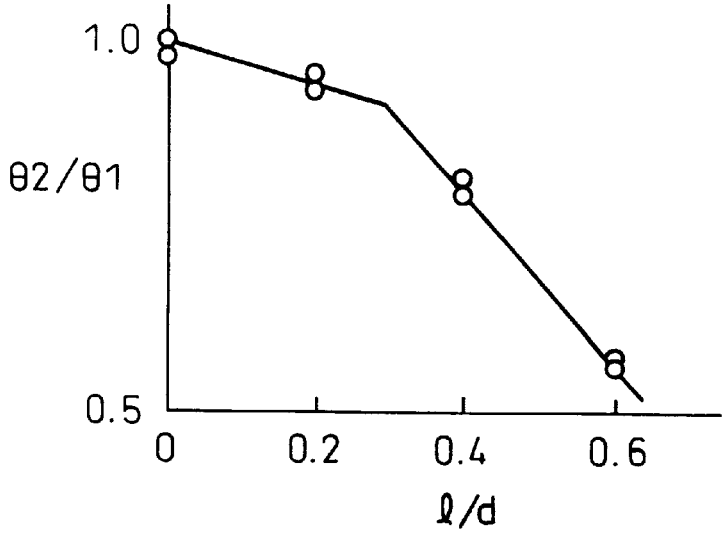
FIG. 7 is a graph illustrating a relationship between the ratio of the length of the passage portion of the injection hole to the diameter of the fuel reservoir and the ratio of the included angle of the spray to the included angle of the injection hole of the fan shape.

FIG. 7 is a graph illustrating a relationship between the ratio of the length (l) of the passage portion to the diameter (d) of the fuel reservoir 7*b* and the ratio of the vertical angle (θ2) of the spray of the fan shape really formed under the standard atmospheric pressure to the vertical angle (θ1) of the injection hole 8 of the fan shape. Here, the results are obtained by setting the amount (b) of deviation to 0.2 mm constantly, the vertical angle (θ1) of the injection hole 8 of the fan shape to 50 degrees constantly, and by changing the length (l) of the passage portion. As the ratio (l/d) of the length (l) of the passage portion to the diameter (d) of the fuel reservoir 7*b* decreases, the ratio (θ2/θ1) of the included angle (θ2) of the spray of the fan shape really formed under the atmospheric pressure to the included angle (θ1) of the injection hole 8 of the fan shape to approaches 1, from which it is learned that the spray is obtained in a shape as contemplated by setting the ratio (l/d) to be small. Here, when the ratio (l/d) is not larger than 0.2, a change in the ratio (θ2/θ1) becomes small relative to a change in the ratio (l/d). This is attributed to the length (l) of the passage portion 9 being so small as can be substantially neglected in relation to the diameter (d) of the fuel reservoir 7*b*. Upon setting the ratio (l/d) to be not larger than 0.2, therefore, it is possible to obtain the spray having an included angle closer to the included angle (θ1) of the injection hole 8 of the fan shape. Besides, a change in the ratio (θ2/θ1) decreases relative to the change in the ratio (l/d) and, hence, the effect caused by error in the ratio (l/d) can be decreased, and the spray can be formed as contemplated.

If the fuel injector 7 is used for the direct cylinder injection-type spark-ignition internal combustion engine as shown in FIG. 1, the spray of a predetermined amount of fuel which is sufficiently atomized and has a small dispersion in the concentration, can be supplied into the combustion chamber 5*a* in the top surface of the piston in the compression stroke to accomplish a stratified combustion. Therefore, the stratified combustion takes place more stably. Besides, since the spray of fuel has a small thickness, a relatively large amount of fuel can be introduced into the combustion chamber while the piston moves in a latter half of the compression stroke. Thus, the region of stratified combustion can be expanded toward the high-load side.

In the present embodiment, the tip portion of the fuel reservoir 7*b* has a hemispherical shape. However, only the shape of the boundary portion with the passage portion 9 in the fuel reservoir 7*b* is important. The fuel pressure acting on each portion of the injection hole 8 can be nearly uniform if the boundary line between the fuel reservoir 7*b* and the passage portion 9 is an arc on each transverse plane within the height of the injection hole 8.

Although the invention has been described with reference to specific embodiments thereof, it should be apparent that numerous modifications can be made thereto by those skilled in the art, without departing from the basic concept and scope of the invention.

What is claimed is:

1. A fuel injector for an internal combustion engine, comprising an injection hole, a valve body, and a fuel reservoir on the downstream side of a seat portion of said valve body, wherein the width of said injection hole is gradually narrowed inward at a predetermined included angle, an opening on the outer side of said injection hole has a width sufficiently larger than the height thereof, a tip portion of said fuel reservoir is communicated with said injection hole via a passage portion which has a uniform cross section, on each transverse plane within said height of said injection hole, said tip portion of said fuel reservoir has an arc shape, on the transverse plane passing through the center of said height of said injection hole, said tip portion of said fuel reservoir has a hemicircle shape and the vertex of said predetermined included angle is located on the upstream side of the center of said hemicircle shape.

2. A fuel injector according to claim 1, wherein the ratio of the length of said passage portion to the diameter of said hemicircle shape is not larger than 0.2.

3. A fuel injector according to claim 1, wherein said tip portion of said fuel reservoir has a hemispherical shape.

* * * * *